US011624525B2

(12) United States Patent
Olson

(10) Patent No.: US 11,624,525 B2
(45) Date of Patent: Apr. 11, 2023

(54) LOW-POWER HVAC REMOTE CONTROLLER AND METHOD OF OPERATING THE SAME

(71) Applicant: Mitsubishi Electric US, Inc., Cypress, CA (US)

(72) Inventor: Rodney Olson, Flowery Branch, GA (US)

(73) Assignee: MITSUBISHI ELECTRIC US, INC., Cypress, CA (US)

( * ) Notice: Subject to any disclaimer, the term of this patent is extended or adjusted under 35 U.S.C. 154(b) by 16 days.

(21) Appl. No.: 17/217,239

(22) Filed: Mar. 30, 2021

(65) Prior Publication Data

US 2022/0316735 A1 Oct. 6, 2022

(51) Int. Cl.

| | |
|---|---|
| ***F24F 11/30*** | (2018.01) |
| ***F24F 11/56*** | (2018.01) |
| ***F24F 11/52*** | (2018.01) |
| *F24F 110/20* | (2018.01) |
| *F24F 120/10* | (2018.01) |
| *F24F 110/10* | (2018.01) |

(52) U.S. Cl.

CPC ..... *F24F 11/56* (2018.01); *F24F 11/30* (2018.01); *F24F 11/52* (2018.01); *F24F 2110/10* (2018.01); *F24F 2110/20* (2018.01); *F24F 2120/10* (2018.01)

(58) Field of Classification Search

CPC . G05B 15/02; F24F 11/56; F24F 11/30; F24F 11/52; F24F 2110/20; F24F 2110/10; F24F 2120/10

See application file for complete search history.

(56) References Cited

U.S. PATENT DOCUMENTS

| | | | | |
|---|---|---|---|---|
| 6,179,214 | B1 * | 1/2001 | Key | G05D 23/1904 236/51 |
| 7,703,694 | B2 | 4/2010 | Mueller et al. | |
| 9,151,510 | B2 | 10/2015 | Leen | |
| 9,285,134 | B2 | 3/2016 | Bray et al. | |
| 10,241,527 | B2 * | 3/2019 | Fadell | F24D 19/1084 |
| 10,317,101 | B2 * | 6/2019 | Trikha | F24F 11/30 |
| 10,767,879 | B1 | 9/2020 | Burnett | |
| 2005/0161517 | A1 * | 7/2005 | Helt | F24F 11/30 236/1 C |

(Continued)

FOREIGN PATENT DOCUMENTS

WO 2019/232207 A1 12/2019

*Primary Examiner* — Alicia M. Choi

(74) *Attorney, Agent, or Firm* — Posz Law Group, PLC

(57) ABSTRACT

A heating, ventilation and air-conditioner (HVAC) remote controller for providing instructions for operation of an HVAC system, including a processor configured to control operation of the HVAC remote controller and to generate instructions for the operation of the HVAC system; a pixelated display configured to consume less power when the pixelated display is in a static state than when it is not in the static state; a local input device configured to accept data from an operator; a light configured to illuminate the pixelated display; an isolated power source configured to provide operational power to at least the processor, the pixelated display, and the light; wherein the controller is configured to keep the light turned off except when the processor is actively performing an operation to control the HVAC system.

13 Claims, 4 Drawing Sheets

(56) References Cited

U.S. PATENT DOCUMENTS

| | | | | |
|---|---|---|---|---|
| 2006/0016898 | A1* | 1/2006 | Ashworth | G05D 23/1902 236/1 C |
| 2006/0060658 | A1* | 3/2006 | Proffitt | G05D 23/1902 236/94 |
| 2007/0045430 | A1* | 3/2007 | Chapman, Jr. | G05D 23/1902 236/46 C |
| 2007/0241203 | A1* | 10/2007 | Wagner | F24F 11/30 236/10 |
| 2013/0013118 | A1* | 1/2013 | Merkulov | G05D 23/1902 700/286 |
| 2013/0066474 | A1* | 3/2013 | Coogan | F24F 11/58 700/278 |
| 2013/0226354 | A9* | 8/2013 | Ruff | G05D 23/27 700/278 |
| 2013/0229444 | A1* | 9/2013 | Teranishi | G09G 5/10 345/690 |
| 2014/0321160 | A1 | 10/2014 | Novotny et al. | |
| 2015/0112456 | A1 | 4/2015 | Sikora et al. | |
| 2015/0369508 | A1* | 12/2015 | Rosen | F24F 11/30 236/1 C |
| 2016/0033156 | A1* | 2/2016 | Okazaki | G05B 15/02 700/276 |
| 2017/0059190 | A1* | 3/2017 | Stefanski | G05D 23/193 |
| 2018/0224143 | A1* | 8/2018 | Anderson | F24D 19/1084 |
| 2022/0316735 | A1* | 10/2022 | Olson | F24F 11/30 |

* cited by examiner

LOW-POWER HVAC REMOTE CONTROLLER AND METHOD OF OPERATING THE SAME

TECHNICAL FIELD

The disclosed devices and methods relate generally to a remote controller for a heating, ventilation, and air-conditioning (HVAC) system. More particularly, the disclosed devices and methods relate to an HVAC remote controller that uses a low-power pixelated display and limits the amount of time a display light is activated to reduce power consumption by the HVAC remote controller.

BACKGROUND

A heating, ventilation, and air conditioning (HVAC) system can be controlled by a remote controller that can be located at a point of convenience within a space whose temperature is to be controlled. Given that the point of convenience may not have a wired power source available, an HVAC remote controller may be battery powered. In such a case, the amount of power consumed by the HVAC remote controller will be an issue of concern so that the time period between having to change batteries can be minimized.

One of the parts of an HVAC remote controller that uses power is a display unit. A display unit is generally provided in the HVAC remote controller so that a user can visually identify environmental or operational information such as current temperature, set point temperature, current humidity, desired humidity, etc., when operating the remote controller. In some cases, the display will also be a capacitive touch screen that allows a user to enter controls without the need for additional input devices on the HVAC remote controller. Such a display unit consumes power during a display operation based on the parameters of the display unit used.

A display unit will also often have an integrated light that illuminates the display portion of the display unit to allow it to be more clearly seen by a user. If a touch screen is used on the HVAC remote controller, it must also be illuminated any time the user is entering data via the touch screen. A display light consumes power whenever it is on, causing a drain on the HVAC remote controller's limited power source.

It would therefore be desirable to provide an HVAC remote controller that minimized the amount of power that it used to maximize the life of a local power source, such as a battery.

SUMMARY OF THE INVENTION

According to one or more embodiments, a heating, ventilation and air-conditioner (HVAC) remote controller is provided for providing instructions for operation of an HVAC system, comprising: a processor configured to control operation of the HVAC remote controller and to generate instructions for the operation of the HVAC system; a pixelated display configured to consume less power when the pixelated display is in a static state than when it is not in the static state; a local input device configured to accept data from an operator; a light configured to illuminate the pixelated display; an isolated power source configured to provide operational power to at least the processor, the pixelated display, and the light; wherein the controller is configured to keep the light turned off except when the processor is actively performing an operation to control the HVAC system.

The processor may be further configured to actively perform the operation to control the HVAC system based on at least one of the following: the processor receives instructions from the operator via the local input device, the processor receives data or instructions from another element in the HVAC system that requires an alteration of at least one system parameter, and the processor performs a regular periodic operation.

The HVAC remote controller may further comprise: a communication interface configured to receive instructions from the processor and wirelessly transmit the instructions to a remote device in the HVAC system.

The communication interface may further comprise: a first instructions wireless interface configured to wirelessly transmit the instructions to the remote device in the HVAC system using a first transmission protocol; and a second instructions wireless interface configured to wirelessly transmit the instructions to the remote device in the HVAC system using a second transmission protocol different from the first transmission protocol.

The HVAC remote controller may further comprise: one or more system parameter sensors configured to measure system parameters proximate to the HVAC remote controller.

The one or more system parameter sensors may include at least one of a temperature sensor, a humidity sensor, and an occupancy sensor.

The local input device may be a touch panel configured to accept data from the pixelated display by the operator's touch.

The isolated power source may be a battery.

The pixelated display may be selected from one of a memory-in-pixel display and an indium gallium zinc oxide (IGZO) display.

The light may be one of a backlight or a front light.

A method of operating a heating, ventilation and air-conditioner (HVAC) remote controller associated with an HVAC system is provided, comprising: displaying operational information on a pixelated display; turning off a display light used to illuminate the pixelated display after displaying the operational information on the pixelated display; monitoring one or more data input devices for input data; and determining that no input data has been received at the one or more input data devices for a threshold time.

The one or more data input devices may include a communication interface configured to receive system data and operational instructions from a distant HVAC unit.

The system data from the distant HVAC unit may be one of temperature data indicating a temperature proximate to the distant HVAC unit and humidity data indicating a humidity proximate to the distant HVAC unit.

The one or more data input devices may include a local input device connected to the HVAC remote controller.

The local input device may be a touch panel configured to accept data from the pixelated display by the operator's touch.

The communication interface may be one of a Wi-fi interface, a wireless interface, and a wired interface.

The pixelated display may be selected from one of a memory-in-pixel display and an indium gallium zinc oxide (IGZO) display.

The threshold time may be between one and ten minutes.

The one or more periodic HVAC control operations may include a parameter updating operation for updating local system parameters.

The local system parameters may include at least one of a local temperature proximate to the HVAC remote controller, a local humidity proximate to the HVAC remote controller, an indication of whether there are occupants in a room associated with the HVAC remote controller.

The one or more periodic HVAC control operations may further include a transmission operation for transmitting updated local system parameter to a distant HVAC unit.

A method of operating a heating, ventilation and air-conditioner (HVAC) remote controller associated with an HVAC system is provided, comprising: displaying operational information on a pixelated display; turning off a display light used to illuminate the pixelated display after displaying the operational information on the pixelated display; monitoring one or more data input devices for input data; determining that the input data has been received at the one or more input data devices; turning on the display light after determining that the input data has been received at the one or more data input devices; performing one or more operations based on the input data after turning on the display light; updating the operational information on the pixelated display after performing the one or more operations; and turning off the display light after update the operational information on the pixelated display.

The one or more data input devices may include a communication interface configured to receive system data from a distant HVAC unit.

The system data from the distant HVAC unit may be one of temperature data indicating a temperature proximate to the distant HVAC unit and humidity data indicating a humidity proximate to the distant HVAC unit.

The one or more data input devices may include a local input device connected to the HVAC remote controller and configured to accept the input data from an operator.

The input data may include one of instructions to change one or more setpoints for the HVAC system, instructions to change a mode of operation of the HVAC system, instructions to turn the HVAC system on or off, instructions to change a direction of vanes associated with one or more distant HVAC devices in the HVAC system, and instructions to change a speed of one or more fans associated with one or more distant HVAC devices.

The local input device may be a touch panel configured to accept data from the pixelated display by the operator's touch.

The communication interface may be one of a Wi-fi interface, a wireless interface, and a wired interface.

The pixelated display may be selected from one of a memory-in-pixel display and an indium gallium zinc oxide (IGZO) display.

BRIEF DESCRIPTION OF THE DRAWINGS

The accompanying figures, where like reference numerals refer to identical or functionally similar elements and which together with the detailed description below are incorporated in and form part of the specification, serve to further illustrate an exemplary embodiment and to explain various principles and advantages in accordance with the present disclosure.

DETAILED DESCRIPTION

Introduction

In overview, the present disclosure concerns an HVAC remote controller that controls a plurality of indoor HVAC units. Such remote controllers often have internal power supplies such as batteries. As a result, the amount of power the HVAC remote controller expends can be a matter of concern.

The remote controller includes a display for displaying operational information and is configured such that it maintains what is on the display when unpowered. The display also has a light used to illuminate the display. The HVAC remote controller defaults to having the light off and only turns it on when accessed by a user or an indoor HVAC unit, when it receives information from a remote unit, or when it must perform certain periodic operations.

In this way, the HVAC remote controller only causes the display and the display light to consume power when the HVAC remote controller is actively performing system operations. In between such operations the HVAC remote controller can turn off the display light and can stop updating the information on the display to save power. In some embodiments the HVAC remote controller can even enter a general power-saving mode when not actively performing operations.

Various inventive concepts and principles are embodiments in systems, devices, and methods therein which provide an HVAC remote controller that reduces power consumption of the device. solves a problem of unequal air flows between the two sides of the blower wheel. Furthermore, the disclosed air handler blower will equalize air flow between the two sides of the blower wheel in a variety of configurations and placements of the air handler blower.

The instant disclosure is provided to further explain in an enabling fashion the best modes of performing one or more embodiments. The disclosure is further offered to enhance an understanding and appreciation for the inventive principles and advantages thereof, rather than to limit in any manner the embodiments.

It is further understood that the use of relational terms, such as first and second, if any, are used to distinguish one from another entity, item, or action without necessarily requiring or implying any actual such relationship or order between such entities, items or actions. Some embodiments may include a plurality of processes or steps, which can be performed in any order unless expressly and necessarily limited to a particular order (i.e., processes or steps that are not so limited may be performed in any order).

As further discussed below, various inventive principles and combinations thereof are advantageously employed to provide an HVAC remote controller that minimizes the amount of power it consumes by employing a display and display light that operate efficiently.

HVAC Remote Controller

Figure 1:
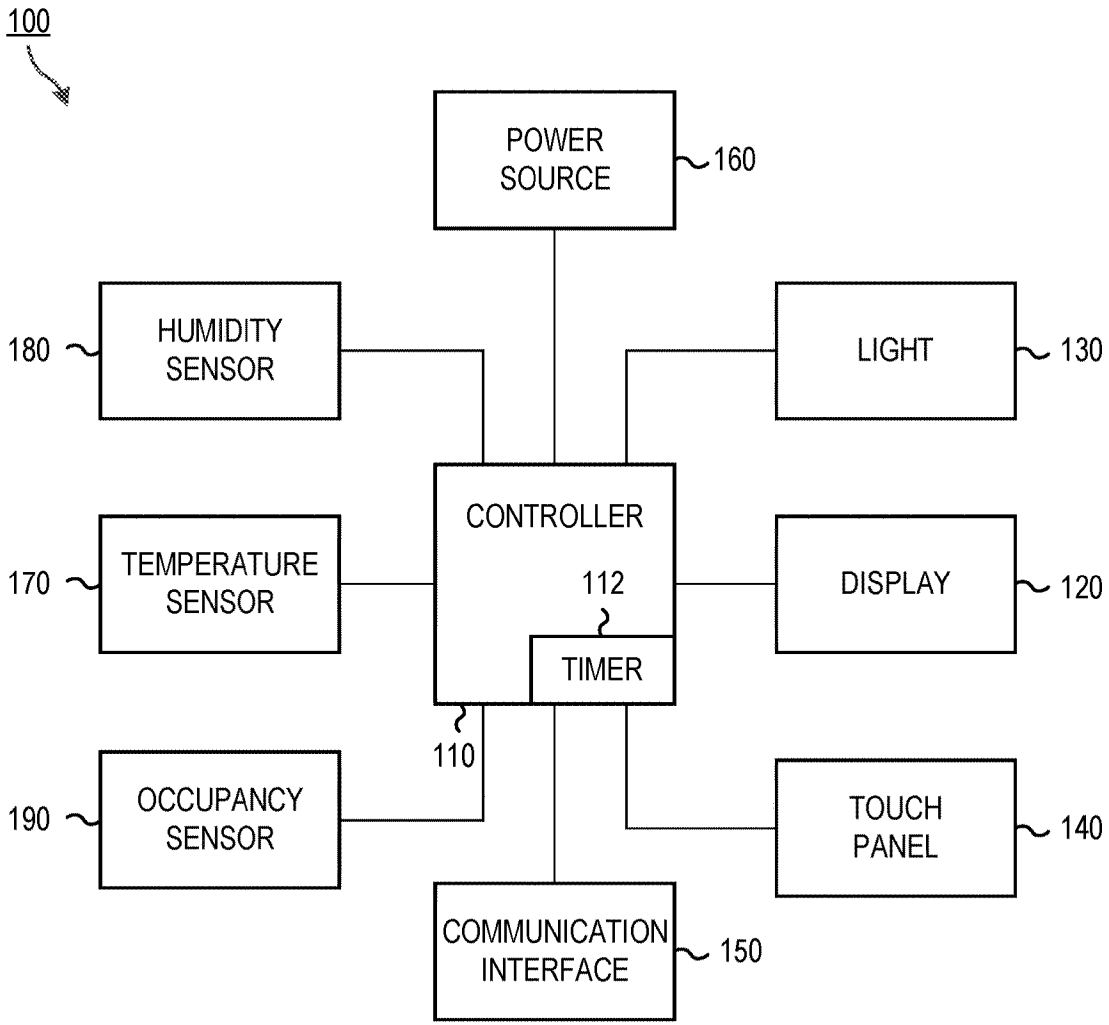
FIG. 1 is a diagram of an HVAC remote controller according to disclosed embodiments.

FIG. 1 is a diagram of an HVAC remote controller 100 according to disclosed embodiments. As shown in FIG. 1, the HVAC remote controller 100 includes a controller 110, a display 120, a display light 130, a touch panel 140, a communication interface 150, a power source 160, a temperature sensor 170, a humidity sensor 180, and an occupancy sensor 190. The controller 110 can further include a timer 112.

The controller 110 controls the operation of the HVAC remote controller 100 based on information and programs stored in firmware and/or in a memory (not shown) associated with the controller 110 or based on information and instructions received from a user. It may comprise one or more microprocessors, one or more digital signal processors, and/or one or more application-specific integrated circuits. It may also include one or more internal memory structures.

The controller 110 is configured to receive information and instructions from a user via the touch panel 140 or from a distant device via the communication interface 150. It is also configured to perform one or more periodic operations based on instructions stored in memory or firmware. These periodic operations could include updating a locally measured temperature, updating a locally measured humidity, updating a determination as to whether any people are in an area or zone associated with the HVAC remote controller, sending some or all of this information to distant devices, etc.

The controller is further configured to control the elements in the HVAC remote controller 100 based on the information and/or instructions received via either the touch panel 140 or the communication interface 150 or based on the periodic operations. This could involve reading information from one or more of the sensors 170, 180, 190, changing the information that is displayed on the display 120, turning the display light 130 on or off, monitoring an elapsed time via the timer 112, or sending information to a distant device via the communication interface 150.

The timer 112 operates to measure elapsed time. It may include a counter within the controller 110 or any device that the controller 110 could use to measure elapsed time. The controller 110 can use the timer 112 to determine whether an elapsed time from a certain trigger point reaches or exceeds a time threshold. This allows the controller 110 to take actions based on an elapsed time since a trigger point.

The display 120 is configured to display system information in a manner that can be read by a user. In various embodiments it can be a pixelated display whose pixels can be controlled to display a wide variety of information. Such an embodiment allows a single pixelated display to be used to display a variety of information obviating the need for multiple displays.

In some embodiments, the display 120 can be a low-power display circuit that maintains whatever it displays without consuming power and only consumes power when it changes a display state, i.e., the information shown on the display. One example of this kind of low-power pixelated display is a memory-in-pixel (MIP) display. An MIP display allows a controller to only change pixels that need to be changed, leaving unchanged pixels alone. Another example of this kind of low-power pixelated display is an indium gallium zinc oxide (IGZO) display. An IGZO display is a thin-film-transistor (TFT) display that uses an indium gallium zinc oxide semiconductor in the backplane of the display. IGZO displays only consume power when they are changing how a pixel is displayed. Unchanged pixels in such displays remain in their current state without consuming any power. MIP displays consume much less power when the display is static (i.e., unchanging) as compared to when they are changing how pixels are displayed.

By using a low-power display circuit that maintains whatever it displays without consuming power and only consumes power when it changes a display state, the display 120 can reduce the amount of power it consumes overall. In part this is because many HVAC remote controllers 100 are only operated for a fraction of the day. Thus, during a large part of any given day, the display 120 on the HVAC remote controller 100 will remain unchanged. A low-power pixelated display as described above will not consume any power during these times.

The display light 130 is a lighting circuit provided to illuminate the display 120. In various embodiments it can be a backlight or a front light. A backlight illuminates a display 120 such as a pixelated display panel from the side or back of the display panel. A front light illuminates the display 120 from the front of the display panel.

The touch panel 140 is provided as an exemplary local input circuit in the HVAC remote controller 100. The touch panel 140 is typically a panel such as glass that allows a user to enter data into the HVAC remote controller through touch. One example of a touch panel is a capacitive touch panel that uses a person's inherent capacitance to determine a location on a panel that a user is touching. By allowing different inputs at different positions on the panel and detecting where the user touches, the touch panel 140 can receive input information from the user.

When a touch panel 140 is used as a local input circuit, the touch panel 140 and the display 120 can together form a touch screen. In such a case, the touch panel 140 provides the input functionality of the touch screen and the display 120 provides the output functionality of the touch screen.

In alternate embodiments other types of touch panel 140 can be used. For example, a resistive touch panel, a surface acoustic wave touch panel, an infrared touchscreen, an optical touch panel, a dispersive signal technology touch panel, an acoustic pulse recognition touch panel, or any suitable touch panel technology can be used.

Furthermore, a touch panel 140 is used by way of example only as a local input circuit. Alternate embodiments can employ other configurations for a local input circuit. For example, a panel of buttons such as a numeric keypad or a text keypad could be used as a local input circuit in alternate embodiments. Alternatively, a smaller number of buttons or switches could be used.

The communication interface 150 allows the HVAC remote controller 100 to communicate with distant devices such as other elements within an HVAC system, a general computer system, a cell phone, or any other remote device that might provide information, control signals, or operational instructions, or which may receive information, control signals, or operational instructions. Although the communication interface 150 could be wired or wireless, many embodiments will employ only one or more wireless options within the communication interface 150 to avoid the need for connecting wires. In various embodiments that use only wireless communications the communication interface 150 could include a single wireless circuit allowing the HVAC remote controller 100 to communicate with distant devices using a single wireless protocol or a plurality of different wireless interfaces allowing the HVAC remote controller 100 to communicate with distant devices using multiple wireless protocols.

The power source 160 provides power to the various elements in the HVAC remote controller 100. Although the power source 160 may be a wired power source that connects to a constant power supply such as building electrical power, many embodiments will employ a local power source that is a disconnected power source such as a battery. Some alternate embodiments could have the power source offer the option for both a connected power supply or a disconnected power supply, using the connected power supply when possible and the disconnected power supply when the connected power supply is not available, e.g., during an interruption of the connected power supply or when the HVAC remote controller is temporarily disconnected from the connected power supply.

In embodiments in which the power source 160 is a battery, it can be whatever sort of battery meets the power and size requirements for the HVAC remote controller. One embodiment could use one or more AA batteries, though this is by way of example only. Alternate embodiments could use one or more AAA batteries, one or more 9-volt batteries, or any kind of battery that meets the size and power requirements of the HVAC remote controller 100.

In addition to the control capabilities of the controller 110, the input/output capabilities of the display 120, light 130, and touch panel 140 and the communication capabilities of the communication interface 150, the HVAC remote controller 100 may include one or more sensors, as shown by the disclosed temperature sensor 170, humidity sensor 180, and occupancy sensor 190. Although FIG. 1 discloses a device that has all three of these sensors, alternate embodiments could have more or fewer sensors. Some embodiments could eliminate the sensors altogether.

The temperature sensor 170 operates to measure the temperature proximate to the HVAC remote controller 100. It can be any sort of a temperature sensor including a mechanical temperature sensor or an electronic temperature sensor. The temperature sensor 170 provides this temperature information to the controller 110, which may use it internally or may send the temperature information to a distant device.

The humidity sensor 180 operates to measure the humidity proximate to the HVAC remote controller 100. It can be any sort of suitable humidity sensor. The humidity sensor 180 provides this humidity information to the controller 110, which may use it internally or may send the humidity information to a distant device.

The occupancy sensor 190 operates to determine whether a space or zone containing the HVAC remote controller 100 currently has any occupants present, and in some embodiments may provide an estimate of how many occupants are present. It can be any sort of an occupation sensor including an infrared occupancy sensor, a microwave occupancy sensor, an ultrasonic occupancy sensor, a video image processing occupancy sensor, or any suitable circuit for gathering occupancy information. The occupancy sensor 190 provides this occupancy information to the controller 110, which may use it internally or send the occupancy information to a distant device.

Figure 2:
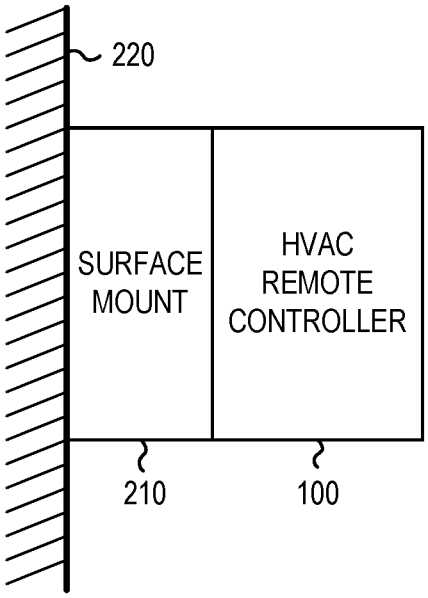
FIG. 2 is a side view of the HVAC remote controller of FIG. 1 when it is attached to a surface according to disclosed embodiments.

In many embodiments the HVAC remote controller 100 may be affixed to a surface, such as a wall or a piece of furniture. FIG. 2 is a side view of the HVAC remote controller 100 of FIG. 1 when it is attached to a surface 220 according to disclosed embodiments.

As shown in FIG. 2, the HVAC remote controller 100 may be affixed to a surface 220 by a surface mount 210 that is attached to both the surface 220 and the HVAC remote controller 100.

The surface 220 may be on a wall, a piece of furniture, or any suitable structure that can support the surface mount 210. In one embodiment, the surface will be a wall inside a space that the HVAC system with which the HVAC remote controller 100 is associated. In many embodiments the surface mount 210 will be arranged at roughly eye-height to allow for more convenient access and visual inspection by a user, though in other embodiments it can be affixed at any position that suits the needs of the HVAC system or the requirements of the space containing the HVAC remote controller 100.

The surface mount 210 can be attached to the surface 220 by any suitable mechanism. For example, it could be attached by screws, molly bolts, one or more adhesive strips, or any other mechanism for attaching a small device to a surface.

In various embodiments the HVAC remote controller 100 can be permanently or semi-permanently affixed to the surface mount 210. In other embodiments the HVAC controller 100 can be removable from the surface mount 210, which serves as a holder for the HVAC controller 100. In embodiments in which the HVAC controller 100 is battery-powered and employs only wireless connections, a removeable HVAC controller 100 could be freely usable in any location in which it can successfully connect wirelessly with other elements in the greater HVAC system.

Figure 3:
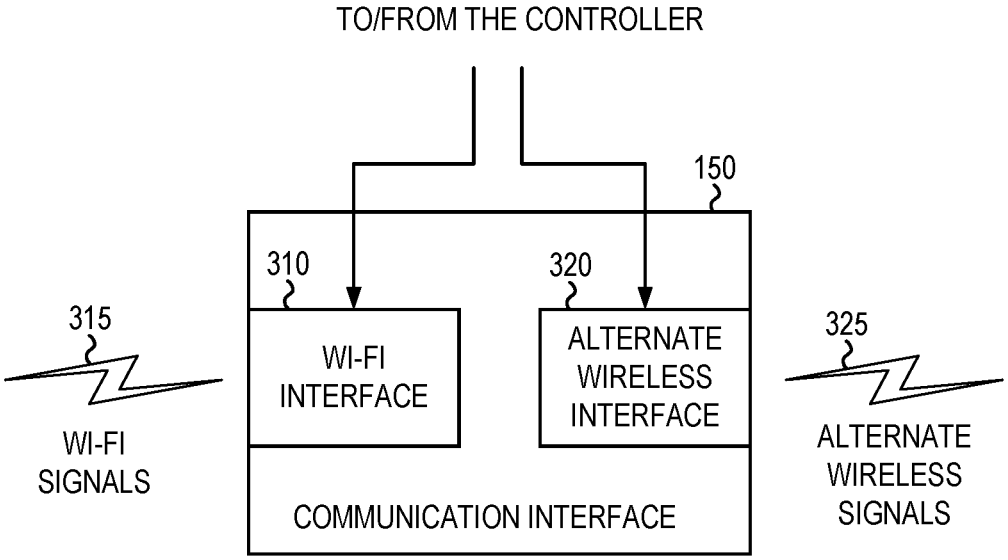
FIG. 3 is a diagram of the communication interface of the HVAC remote controller of FIG. 1 according to disclosed embodiments.

FIG. 3 is a diagram of the communication interface 150 of the HVAC remote controller 100 of FIG. 1 according to disclosed embodiments. As shown in the embodiment of FIG. 3, the communication interface 150 can have multiple wireless interfaces.

As shown in FIG. 3, the communication interface 150 includes a wi-fi interface 310 and an alternate wireless interface 320. The wi-fi interface 310 communicates with one or more distant devices using wi-fi signals 315 (e.g., using an IEEE 802.11 protocol or some variety of an IEEE 802.11 protocol), while the alternate wireless interface 320 communicates with one or more distant devices using alternate wireless signals 325 under a different wireless protocol.

Given the convenience and functionality of wi-fi connections, a wi-fi interface 310 is used in many embodiments. However, this is by way of example only. In alternate embodiments the wi-fi interface 310 could be replaced with a different kind of wireless interface. For example, the wi-fi interface 310 could be replaced with a wireless interface that uses a protocol using the IEEE 802.15.1 standard (e.g., a Bluetooth protocol), a protocol using the IEEE 802.15.4 standard (e.g., a ZigBee protocol), or any suitable wireless protocol.

In various embodiments the alternate wireless interface 320 could use a Bluetooth protocol, a ZigBee protocol, a cellular telephone protocol (e.g., 3G, 4G, or 5G), or any suitable wireless protocol.

In alternate embodiments one or both of the wi-fi interface 310 and the alternate wireless interface 320 could be replaced with a wired interface (e.g., using an Ethernet protocol). In some embodiments the communication interface 150 could include one or more wireless interfaces and one or more wired interfaces. Furthermore, although the embodiment of FIG. 3 discloses the use of two communication interfaces (the wi-fi interface 310 and the alternate wireless interfaces 320), this is by way of example only. Alternate embodiments could use only a single interface circuit or could use more than two interface circuits.

Communication with HVAC System

Figure 4:
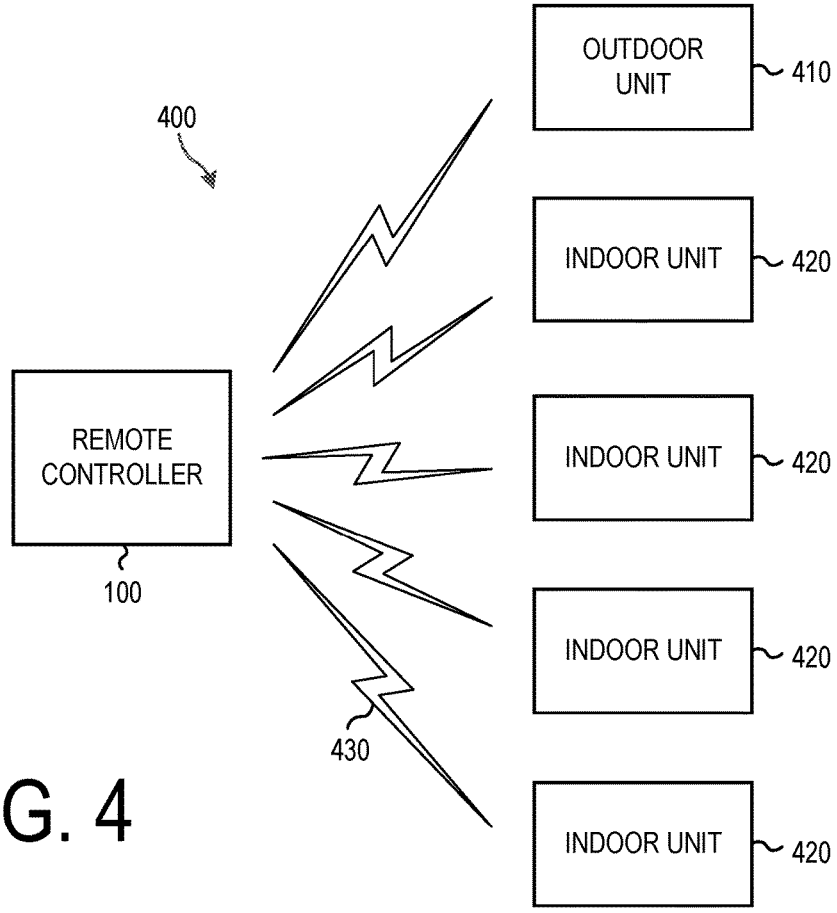
FIG. 4 is a diagram showing communication between an HVAC remote controller and a plurality of indoor HVAC units according to disclosed embodiments.

FIG. 4 is a diagram 400 showing communication between an HVAC remote controller 100 and multiple remote units including an outdoor HVAC unit 410 and multiple indoor HVAC units 420 according to disclosed embodiments. As shown in FIG. 4, a single HVAC remote controller 100 may communicate with a single outdoor HVAC unit 410 and multiple indoor HVAC units 420 in a single HVAC system via wireless communication signals 430. In various embodiments the multiple indoor HVAC units 420 can be in different spaces or zones in an area covered by an HVAC system whose temperature needs to be controlled. It is also possible that in some embodiments multiple HVAC indoor units will be associated with a single space or HVAC zone in the area covered by the HVAC system. Although the embodiment of FIG. 4 shows only one outdoor HVAC unit 410 some embodiments could employ multiple outdoor HVAC units 410.

As shown in FIG. 4, the HVAC remote controller 100 communicates with an outdoor HVAC unit 410 and multiple HVAC indoor units 420. However, alternate embodiments could have the HVAC remote controller 100 communicate with other distant units such as devices associated with and HVAC system (e.g., a humidifier, auxiliary heater, etc.).

In some embodiments the wireless communication signals 430 can all be transmitted using a single protocol (e.g., wi-fi). Alternate embodiments could use multiple different protocols to send signals at different times, under different circumstances, or to different HVAC units 410, 420.

In addition. although FIG. 4 discloses that the HVAC remote controller 100 communicates with the HVAC units 410, 420 using wireless communication signals 430, alternate embodiments could also include wired communication channels in addition to or in place of the wireless communication signals 420.

Figure 5:
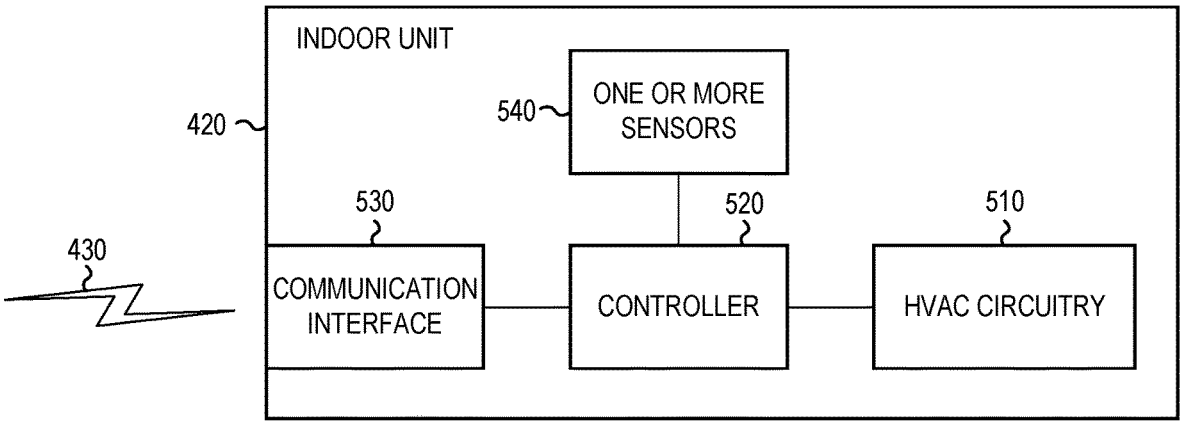
FIG. 5 is a diagram showing an indoor HVAC unit according to disclosed embodiments.

FIG. 5 is a diagram showing an indoor HVAC unit 420 according to disclosed embodiments. As shown in FIG. 5, an indoor HVAC unit 420 includes HVAC circuitry 510, a controller 520, a communication interface 530, and one or more sensors 540.

The HVAC circuitry 510 is the machinery that operates to heat and cool the area being serviced by the HVAC system. It can include a heating coil, electric heater, one or more blowers, one or more vents, one or more filters, a humidifier, a dehumidifier, and anything else needed to facilitate indoor heating and cooling operations.

The controller 520 is configured to control the elements in the HVAC circuitry 510 based on the information and/or instructions either received from a user, received from a distant device, or contained in a memory associated with the controller 520.

The controller 520 controls the operation of the HVAC circuitry 510 based on information and programs stored in firmware and in a memory (not shown) associated with the controller 520, based on information and instructions received from a user, or based on information and/or instructions received from a distant device. The user can provide instructions to the controller through direct input to the controller 520 via an input device (not shown) or through signals 430 received by the communication interface 530. These received signals could be from the HVAC remote controller 100 or from a different controlling device.

The controller 520 may comprise one or more microprocessors, one or more digital signal processors, and/or one or more application-specific integrated circuits. It may also include one or more internal memory structures.

The communication interface 530 allows the controller 520 to communicate with distant devices such as the HVAC remote controller 100, other elements within the HVAC system, a general computer system, a cell phone, or any other remote device that might provide information, control signals, or operational instructions, or which may receive information, control signals, or operational instructions.

Although the communication interface 530 could be wired or wireless, many embodiments will employ only one or more wireless options within the communication interface 150 to avoid the need for connecting wires. In various embodiments that use only wireless communications the communication interface 530 could include a single wireless circuit allowing the HVAC remote controller 100 to communicate with distant devices using a single wireless protocol or a plurality of different wireless interfaces allowing the controller 520 to communicate with distant devices using multiple wireless protocols. To communicate with the HVAC remote controller 100, the communication interface 520 should share a communication protocol with the communication interface 150 in the HVAC remote controller 100.

The one or more sensors 540 operate to sense local conditions proximate to the HVAC indoor unit 420. The one or more sensors can include a temperature sensor, a humidity sensor, an occupancy sensor, or any kind of sensor that could sense a parameter that could be used by the controller 520 to control operation of the HVAC indoor unit 420. Various embodiments could include more of fewer sensors in the one or more sensors 540. Some embodiments could eliminate the one or more sensors 540 altogether.

Method of Operation

Figure 6:
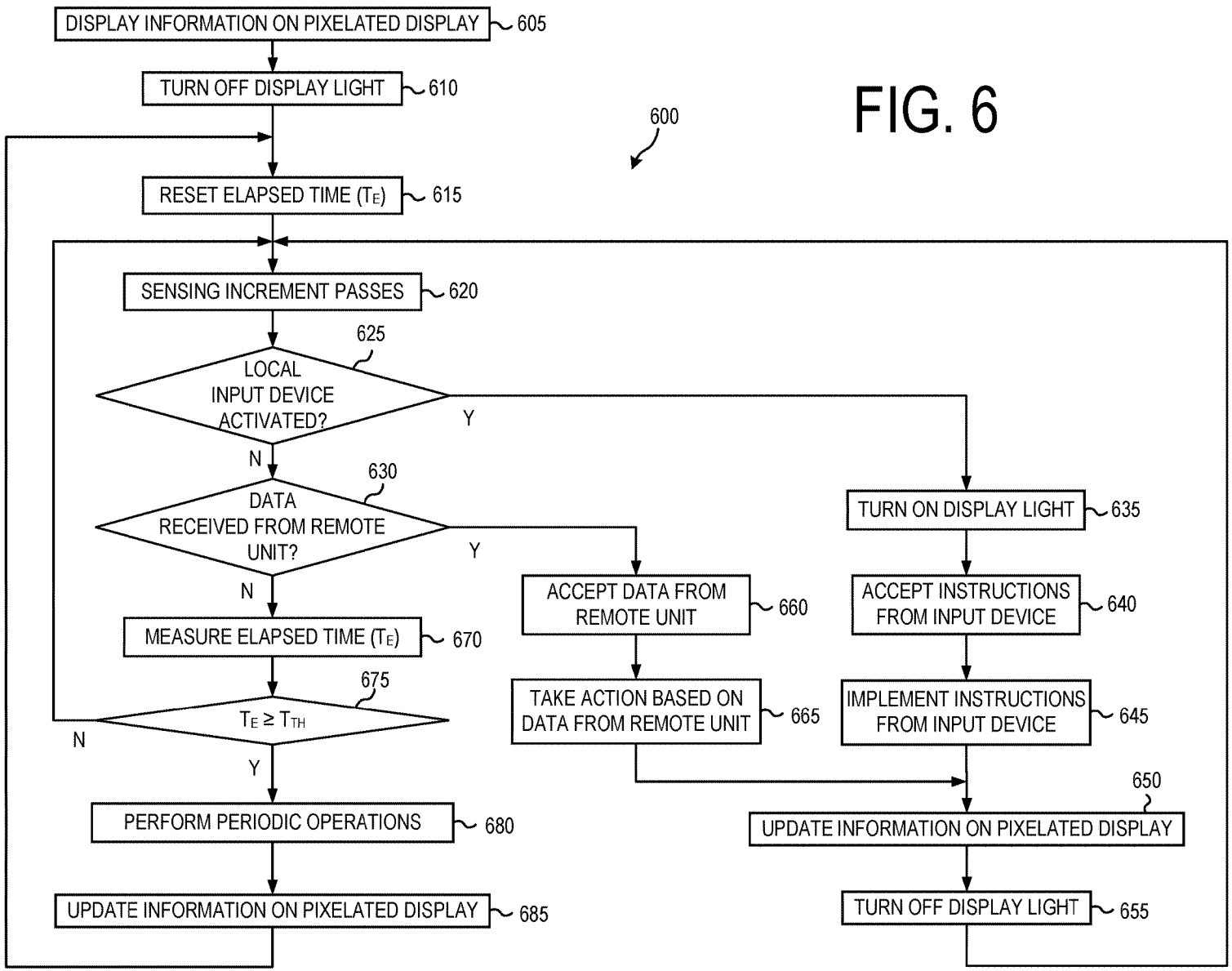
FIG. 6 is a flow chart showing the operation of an HVAC remote controller according to disclosed embodiments.

FIG. 6 is a flow chart 600 showing the operation of an HVAC remote controller according to disclosed embodiments. This operation allows an HVAC remote controller to operate in a manner that will avoid unnecessary power usage by a display associated with the HVAC remote controller. By limiting power usage by the HVAC remote controller, the system can extend the life of a local power source (e.g., battery) that powers the HVAC remote controller.

As shown in FIG. 6, the operation begins when information is displayed on a pixelated display associated with the HVAC remote controller (605). This pixelated display is preferably a display that will maintain displayed information when the display is unpowered and will only consume power when information displayed on the display is changed.

After the information is displayed on the pixelated display, a light associated with the display is set to be off (610). This light could be shut off if it is presently on or maintained in an off state if it is not presently on.

A measurement of elapsed time $T_E$ is then reset to begin a timer (615). This timer will measure the time from when certain periodic operations have been performed.

The system will then allow a sensing increment to pass (620) and will determine whether a local input device has been activated (625). This local input device is local to the HVAC remote controller and is configured to allow a user to directly enter information or instructions to the HVAC remote controller. In various embodiments the local input device can be a touch panel, a keypad, a keyboard, a set of buttons, a set of switches, or any suitable circuit for receiving information or instructions from a user, though a pixelated touch screen is preferred.

If the local input device has been activated (625), the system turns the display light on (635). This will allow the user to more easily see the information displayed on the display. In an embodiment in which the local input device is a touch panel, this will also serve to illuminate the screen associated with the touch panel to allow the user to better see the information on the touch panel.

The system will then accept information or instructions from the input device (640). The information or instructions entered into the input device can include instructions to change one or more temperature setpoints for all or part of the HVAC system, instructions to change the operational mode of the HVAC system (e.g., to or from a heating, cooling, or ventilation mode), instructions to turn the HVAC system on or off, instructions to change a direction of vanes in one or more indoor units associated with the HVAC system, instructions to change a fan speed in one or more indoor units associated with the HVAC system, or any another system parameter that can be changed by a user at an HVAC remote controller.

Once the system receives the instructions from the input device it then implements these instructions (645). In some embodiments this can involve the HVAC remote controller sending instructions via a communication interface to one or more distant devices in the HVAC system, e.g., an indoor unit or an outdoor unit.

The system then updates the information on the pixelated display to reflect any changes made to the operation of the HVAC system (650). Once the information is updated on the display, the system makes certain that the display light is off (655) and returns to allowing a sensing increment to pass (620).

The system also determines whether data has been received by the HVAC remote controller from a remote unit (630). The remote unit could be an indoor unit associated with the HVAC system, an outdoor unit associated with the HVAC system, some other HVAC device associated with the HVAC system, or a remote device otherwise connected to the HVAC system.

If data has been received from a remote unit (630), the system will then accept the data from the remote unit (660). The data received from the remote unit can include sensor information from the remote unit, information regarding a change in status of the remote unit, instructions or information entered in by a user at the remote unit, or anything else that could be relevant to the information displayed on the pixelated display associated with the HVAC remote controller.

Once the system receives the data form the remote unit, it takes whatever action is required at the HVAC remote controller based on the received data (665). In some embodiments this can involve the HVAC remote controller sending instructions or information via a communication interface to one or more distant devices in the HVAC system, e.g., an indoor unit or an outdoor unit.

The system then updates the information on the pixelated display to reflect any changes made to the operation of the HVAC system (650) and returns to allowing a sensing increment to pass (620). Although the operation 600 of FIG. 6 discloses that turning off the display light (655) will be performed after updating the information on the pixelated display (650), no action need be taken in this operation at this time since the display light will already be off.

The system also measures the elapsed time $T_E$ (670) and determines whether the elapsed time $T_E$ is greater than or equal to a time threshold $T_H$ (675). In other words, the system determines whether the threshold time $T_H$ has passed since the timer was started.

If the elapsed time $T_E$ is greater than or equal to a time threshold $T_H$, i.e., if the system determines that the threshold time $T_H$ has passed since the timer was started, the system will then performs one or more periodic operations (680). These periodic operations could include updating a locally measured temperature, updating a locally measured humidity, updating a determination as to whether any people are in an area or zone associated with the HVAC remote controller, sending some or all of this information to distant devices, checking the state of one or more associated HVAC indoor units to update the display id the HVAC indoor unit's state has been changed by another controller, etc.

Once the system has performed the periodic operations (680), it then updates the information on the pixelated display to reflect any changes made to the operation of the HVAC system (685), resets the elapsed time $T_E$ (615), and returns to monitoring the system.

In this way, the system will only turn the display light on when it is needed, i.e., when the local device is activated, when data is received from a remote unit, or when certain periodic operations need to be performed. And it will turn the display light off whenever it is not needed. Likewise, the system will only update information on the pixelated display when something has happened that might change the information on the pixelated display, leaving the display otherwise unchanged. This can limit the power drawn by the display if it is a type that only consumes power when the information on the display is changed. This combination of operations can reduce the power consumed by the HVAC remote controller by limiting the amount of power drawn by a display on the HVAC remote controller and an associated display light.

Although FIG. 6 shows separate operations for the sensing increment passing (620), the system determining whether the local input device is activated (625), the system determining whether data has been received from a remote unit (630), measuring the elapsed time $T_E$ (670), and determining whether the elapsed time $T_E$ is greater than or equal to a time threshold $T_H$ (675), this is just by way of example. These operations can be performed in a different order and can even be performed simultaneously in some embodiments. In the case of simultaneous operation, the system will continually monitor whether the local input device is activated, whether data has been received from a remote unit, whether the elapsed time $T_E$ is greater than or equal to a time threshold $T_H$ as time passes.

In addition, although the operation 600 of FIG. 6 does not disclose turning the display light on when performing the operations of accepting data from a remote unit and taking action based on that received data and then turning the display light off when it has finished taking action based on the received data, this is by way of example only. Alternate embodiments could turn the display light on when the remote controller receives data from the remote unit (630) and then turn the display light off after it has finished updating the information on the pixelated display (650).

Similarly, although the operation 600 of FIG. 6 does not disclose turning the display light on when performing the operations of performing periodic operations (680) and then turning the display light off when the periodic operations are complete, this is by way of example only. Alternate embodiments could turn the display light on when the remote controller determines that the elapsed time $T_E$ is greater than or equal to the time threshold $T_H$ (675), and then turn the display light off after it has finished updating the information on the pixelated display (685).

In some embodiments the operation 600 of FIG. 6 can be implemented by a controller in the HVAC remote controller. This controller can include one or more microprocessors, one or more digital signal processors, and/or one or more application-specific integrated circuits. The controller can implement this operation based on instructions contained in firmware or a memory associated with the controller.

Conclusion

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed:

1. A heating, ventilation and air-conditioner (HVAC) remote controller for providing instructions for operation of an HVAC system, comprising:

a processor configured to control operation of the HVAC remote controller and to generate instructions for the operation of the HVAC system;

a pixelated display configured to display information, the pixelated display consuming more power when changing a display state than when remaining in a current display state;

a touch panel configured to accept data from an operator;

a light configured to illuminate the pixelated display; and an isolated power source configured to provide operational power to at least the processor, the pixelated display, and the light;

wherein the controller is configured to keep the light turned off except when performing operations that require a change in the current display state, the pixelated display continually maintains the displayed information regardless of whether power is provided to the pixelated display, and the processor is further configured to update the pixelated display without turning on the light based on at least one of the following:

the processor receives data or instructions from another element in the HVAC system that requires an alteration of at least one system parameter, and the processor performs a regular periodic operation.

2. The HVAC remote controller of claim 1, further comprising:

a communication interface configured to receive instructions from the processor and wirelessly transmit the instructions to a remote device in the HVAC system.

3. The HVAC remote controller of claim 1, further comprising:

one or more system parameter sensors configured to measure system parameters proximate to the HVAC remote controller.

4. The HVAC remote controller of claim 1, wherein the touch panel is configured to accept data from the pixelated display by the operator's touch.

5. The HVAC remote controller of claim 1, wherein the pixelated display is selected from one of a memory-in-pixel display and an indium gallium zinc oxide (IGZO) display.

6. The HVAC remote controller of claim 1, wherein operations that require a change in the current display state include at least one of receiving instructions from the operator via the local input and accepting data from a remote unit.

7. A method of operating a heating, ventilation and air-conditioner (HVAC) remote controller associated with an HVAC system, comprising:

displaying operational information on a pixelated display;

turning off a display light used to illuminate the pixelated display after displaying the operational information on the pixelated display;

monitoring one or more data input devices for input data;

determining that the input data has been received at the one or more input data devices;

turning on the display light after determining that the input data has been received at the one or more data input devices;

performing one or more operations based on the input data after turning on the display light;

updating the operational information on the pixelated display after performing the one or more operations to control the HVAC system;

turning off the display light after update the operational information on the pixelated display; and updating the operational information on the pixelated display without turning on the display light based on at least one of the following:

receiving data or instructions from an element in the HVAC system that requires an alteration of at least one system parameter, and performing a regular periodic operation.

8. The method of operating an HVAC remote controller of claim 7, wherein the one or more data input devices includes a communication interface configured to receive system data from a distant HVAC unit.

9. The method of operating an HVAC remote controller of claim 8, wherein the system data from the distant HVAC unit is one of temperature data indicating a temperature proximate to the distant HVAC unit and humidity data indicating a humidity proximate to the distant HVAC unit.

10. The method of operating an HVAC remote controller of claim 7, wherein the one or more data input devices include a touch panel connected to the HVAC remote controller and configured to accept the input data from an operator.

11. The method of operating an HVAC remote controller of claim 10, wherein the input data includes one of instructions to change one or more setpoints for the HVAC system, instructions to change a mode of operation of the HVAC system, instructions to turn the HVAC system on or off, instructions to change a direction of vanes associated with one or more distant HVAC devices in the HVAC system, and instructions to change a speed of one or more fans associated with one or more distant HVAC devices.

12. The method of operating an HVAC remote controller of claim 10, wherein the touch panel is configured to accept data from the pixelated display by the operator's touch.

13. The method of operating an HVAC remote controller of claim 7, wherein the pixelated display is selected from one of a memory-in-pixel display and an indium gallium zinc oxide (IGZO) display.

* * * * *